US012458092B2

(12) United States Patent
Wojczak

(10) Patent No.: US 12,458,092 B2
(45) Date of Patent: Nov. 4, 2025

(54) SECURE HEAD WRAP

(71) Applicant: Arachne, LLC, Harrison, NY (US)

(72) Inventor: Sophia Wojczak, Harrison, NY (US)

(73) Assignee: ARACHNE, LLC, Harrison, NY (US)

( * ) Notice: Subject to any disclaimer, the term of this patent is extended or adjusted under 35 U.S.C. 154(b) by 0 days.

(21) Appl. No.: 18/625,393

(22) Filed: Apr. 3, 2024

(65) Prior Publication Data

US 2025/0311802 A1 Oct. 9, 2025

(51) Int. Cl.
*A42B 1/041* (2021.01)
*A42B 7/00* (2006.01)

(52) U.S. Cl.
CPC ..... *A42B 1/041* (2013.01); *A42B 7/00* (2013.01)

(58) Field of Classification Search
CPC ..... A42B 1/041; A42B 1/206; A42B 1/049; A42B 1/06; A42B 1/04; A42B 1/045; A42B 7/00; A42B 1/0186; A42B 1/00; A42B 1/012; A42B 1/208; A42B 1/22; A45D 8/40; A41D 23/00
USPC ..... 2/172, 203, 202
See application file for complete search history.

(56) References Cited

U.S. PATENT DOCUMENTS 1,203,870 A * 11/1916 Hallam et al. ..... A42B 1/045 2/203
1,414,558 A * 5/1922 Ensten ..... A42B 1/041 2/172
1,749,340 A 3/1930 Grean
1,857,574 A * 5/1932 Sykora ..... A42B 1/22 2/195.4
1,920,387 A 8/1933 Harper
1,929,080 A 10/1933 Schramm
2,107,951 A * 2/1938 Lipton ..... A42B 1/041 2/171.7
2,279,867 A * 4/1942 Falk ..... A42B 1/041 132/274
3,321,774 A 5/1967 Tames
4,937,885 A * 7/1990 Gregg ..... A42B 1/041 2/209.12
5,365,613 A 11/1994 Henegan
D381,790 S 8/1997 Harris et al.
D412,234 S 7/1999 Cox
6,789,266 B1 * 9/2004 Mills ..... A42B 1/045 2/202
D498,345 S 11/2004 Maya
6,948,190 B2 9/2005 McGreggor
D753,373 S 4/2016 Esmer
11,051,600 B2 7/2021 McKay
D927,892 S 8/2021 McKay
11,166,508 B2 11/2021 Johnson
11,350,685 B2 * 6/2022 Denu ..... A42B 1/049
D962,598 S 9/2022 McKay
(Continued)

FOREIGN PATENT DOCUMENTS

CH 141515 A * 8/1930
FR 717985 A * 1/1932
GB 137465 A * 1/1920

*Primary Examiner* — Amy Vanatta
(74) *Attorney, Agent, or Firm* — Corner Counsel, LLC

(57) ABSTRACT

A head wrap has a main portion and elongate portion that receives at least part of a person's head. A strap extends from the elongate portion and has a free end. Attachments on the main portion, elongate portion and strap are used to secure the head wrap after being wrapped around a person's head.

10 Claims, 5 Drawing Sheets

(56) References Cited

U.S. PATENT DOCUMENTS

| | | | | |
|---|---|---|---|---|
| 11,547,165 | B2 | 1/2023 | Martin et al. | |
| 11,771,194 | B2 | 10/2023 | Wojczak | |
| 2002/0104150 | A1* | 8/2002 | Hill | A42B 1/041 2/174 |
| 2007/0056079 | A1 | 3/2007 | Didier | |
| 2009/0222969 | A1* | 9/2009 | Townsend | A41D 23/00 2/202 |
| 2010/0299807 | A1* | 12/2010 | Saito | A42B 1/041 2/174 |
| 2017/0042268 | A1 | 2/2017 | Lessard | |
| 2018/0235411 | A1 | 8/2018 | Guerra-Sievers | |
| 2019/0037944 | A1* | 2/2019 | Tussey | A42B 1/049 |
| 2019/0297980 | A1* | 10/2019 | Celaya | A42B 1/06 |
| 2021/0106086 | A1* | 4/2021 | Johnson | A42B 1/049 |
| 2021/0204630 | A1* | 7/2021 | Baylor | A42B 1/041 |

* cited by examiner

SECURE HEAD WRAP

FIELD

The current disclosure relates to head wraps worn on the head after bathing or swimming, worn on the head for warmth, or protecting the hair during sleep.

BACKGROUND

The present disclosure relates to an accessory for use in hair drying, beauty treatments, bathing, swimming, and other self-care activities. A user can use a standard bath towel wrapped around the head and secured with a clip. As the hair dries, the user can dress without wet hair becoming an obstruction. The standard sized bath towel is much larger than necessary for securing and drying a person's wet hair. They are cumbersome and rewrapping of the head may be required. In addition, spas and salons may wish to provide their clients with a higher end towel that can be worn while other beauty services are provided, such as, for example, make-up, manicures, pedicures, etc.

There is a need for a specially sized and shaped head wrap or towel that can be worn after bathing or swimming or during the receipt of beauty services. There is a need for a head wrap or towel that can be secured in a convenient manner, without much difficulty.

SUMMARY

In an aspect, a head wrap comprises a main portion having a closed top and an open bottom. The main portion is shaped to receive at least a top portion of a person's head. An elongate portion extends from the main portion and has an end. A strap extends from the end of the elongate portion and has a free end. The head wrap has a first attachment, a second attachment, and a third attachment. The first attachment is disposed at the free end of the strap, the second attachment is disposed at the front of the main portion, and the third attachment is disposed on the end of the elongate portion. The third attachment is arranged for being attached to the second attachment, and the first attachment is arranged for being attached to the second attachment.

In embodiments, at least one of the first attachment, second attachment, and third attachment comprises a double snap. The main portion of the head wrap can be made from an absorbent material. The strap of the head wrap can be an elongate piece of elastic material.

In embodiments, the main portion is made from a material selected from the group consisting of cotton fabric, terry cloth, silk, reconstituted nylon, and bamboo. The first attachment, second attachment, and third attachment can be selected from the group consisting of snaps, double snaps, buckles, hook and loop fasteners, and buttons and buttonhole fasteners.

In embodiments, the main portion and elongate portion are made from the same material. In embodiments, the main portion and elongate portion are made from different materials. The main portion may have at least one seam. The main portion may be made from an insulating material.

In a further aspect, a head wrap comprises a main portion having a closed top and an open bottom and is shaped to receive at least a top portion of a person's head. An elongate portion extenda from the main portion and has an end. A strap extends from the end of the elongate portion, the strap having a free end. The head wrap has a plurality of attachments spaced along the main portion, elongate portion, and the strap, the attachments securing the head wrap after the elongate portion and strap are wrapped around a person's head.

The attachments can include at least one double snap. The attachments can include at least one tab and hook and loop fasteners. The head wrap can further comprise a second strap. At least one of the main portion, elongate portion, and the strap can be washable.

BRIEF DESCRIPTION OF THE DRAWINGS

The accompanying drawings, which are incorporated in and constitute a part of the present disclosure, illustrate preferred embodiments of the invention and, together with the description, serve to explain the present disclosure. Embodiments of the invention are in no way limited by the following figures.

DETAILED DESCRIPTION

Figure 1:
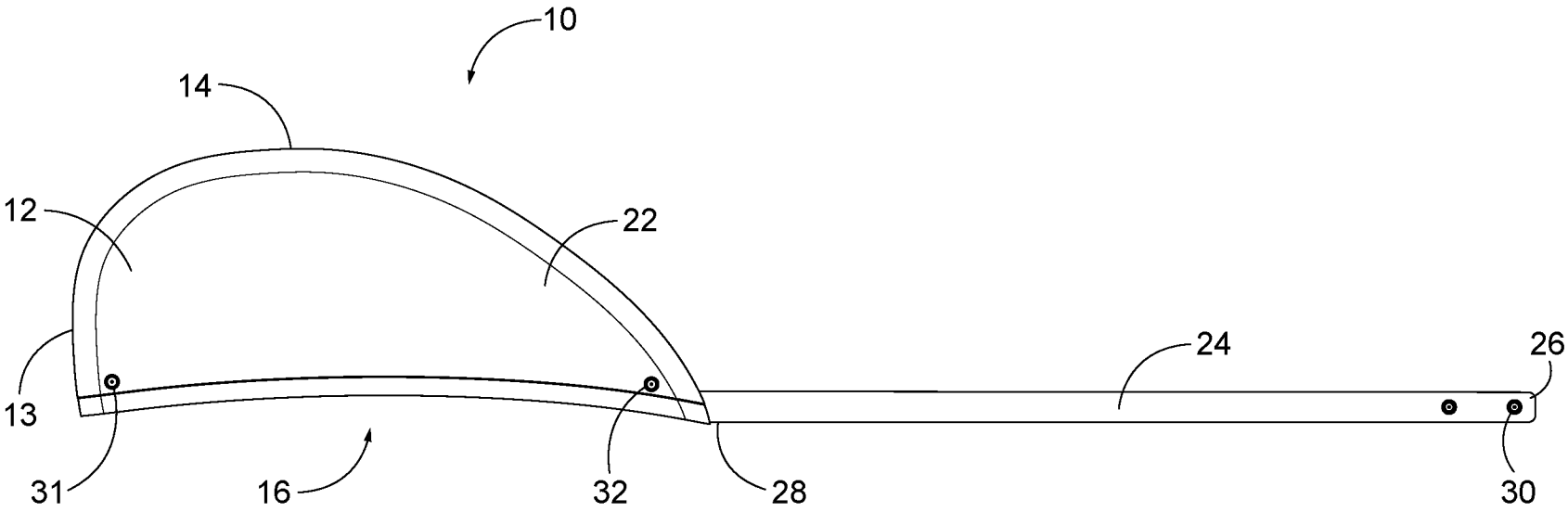
FIG. 1 is a left side elevation view of a head wrap according to embodiments.
Figure 2:
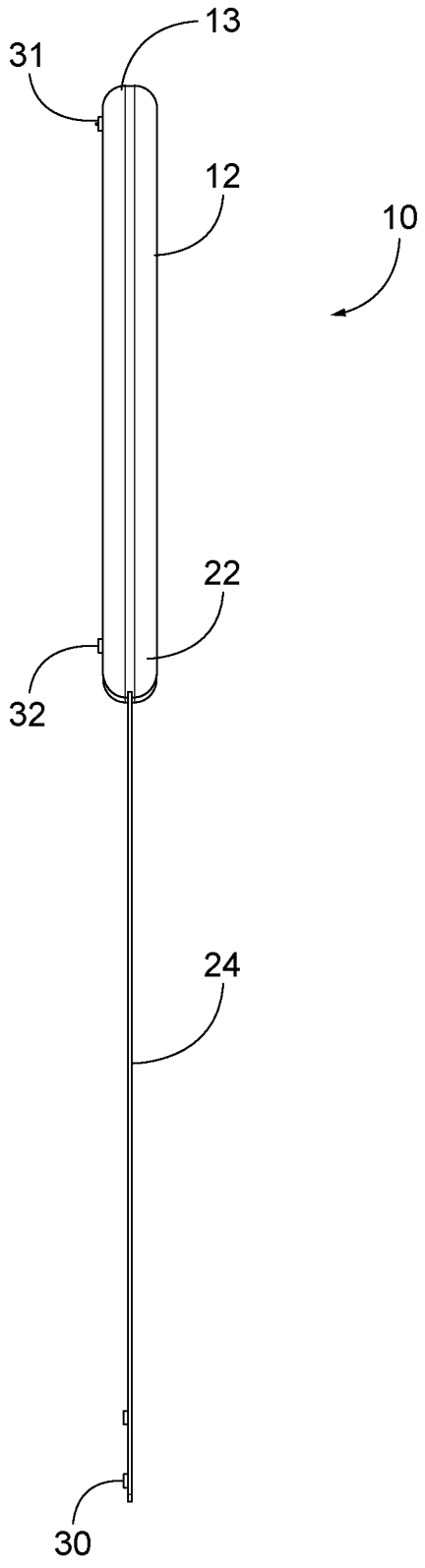
FIG. 2 is a top plan view of the head wrap of FIG. 1.
Figure 3:
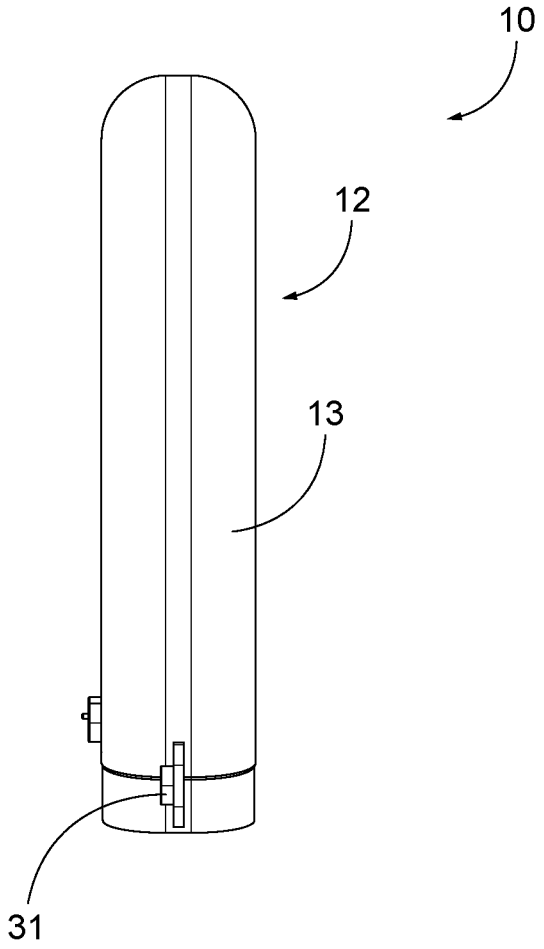
FIG. 3 is a front elevation view of the head wrap of FIGS. 1 and 2.
Figure 4:
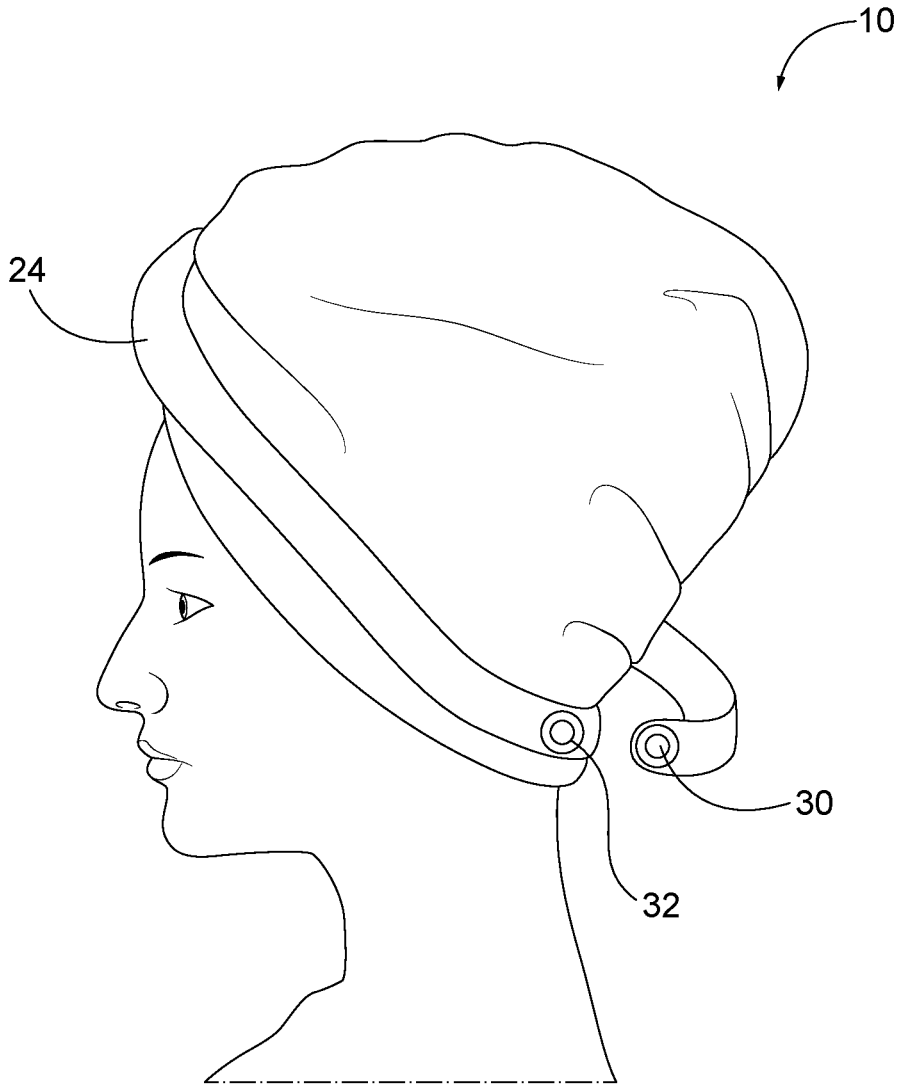
FIG. 4 is a left side perspective view of the head wrap of FIGS. 1 through 3, shown wrapped on a person's head.
Figure 5:
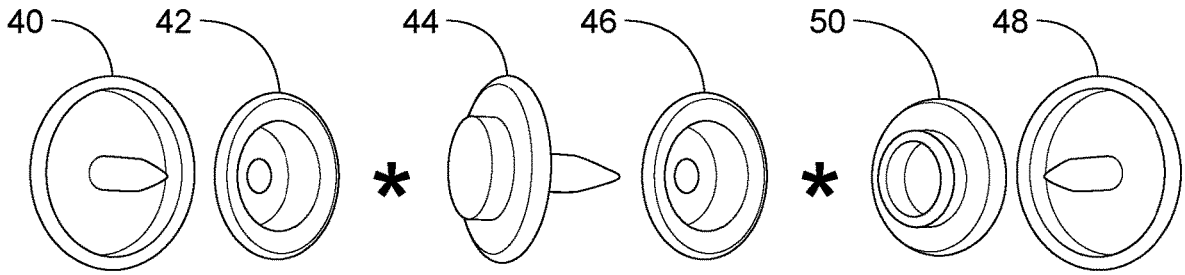
FIG. 5 is an expanded view of an attachment according to embodiments.

A head wrap for wearing on a person's head according to certain embodiments is shown in FIGS. 1 through 4. The head wrap 10 has a main portion 12 that is conically shaped, having a closed top 14 and an open bottom 16. The conical shape of the head wrap 10 has a main portion 12 for receiving the head of a person and an elongate portion 22 for being wrapped around the head and secured. Attached to the elongate portion is a strap 24 arranged for being a wrapped around a person's head. The strap has a free end 26, opposite the end 28 that is attached to the elongate portion. The free end 26 has at least one attachment 30 that cooperates with another attachment 32 adjacent the end of the elongate portion 22. In embodiments, the head wrap 10 includes a first attachment 30 at the free end 26 of the strap, a second attachment 31 at the front end 13 of the main portion 12, and a third attachment 32 at the end of the elongate portion 22. In embodiments, one or more of the snaps are double sided snaps. For example, a double snap could have a female part on one side of the material and a male part on the other side. For example, a double snap can have, in embodiments, a first cap 40, a first female part 42, a first male part 44, a second female part 46, a second male part 48, and a second cap 50. In this way, the snap 32 at the end of the elongate portion 22 is connected to the snap at the front 13 of the main portion 12. The snap 30 at the free end 26 of the strap connects to the snap 31 at the front of the main portion.

In embodiments, other attachments are used, such as a standard snap having a male and a female part that can be connected together. In embodiments, a combination of standard snaps and double snaps are used. In embodiments, the third attachment 32 is a double snap, and the first and second attachments are single snaps. In embodiments, one or more of the attachments are snaps that are over-sized, thumb-sized, thumb-shaped or otherwise has a tactile feel that assists the user in finding and connecting the snaps or other attachment. In embodiments, the attachment may be a buckle, string ties, buttons and button holes, hook and eye fasteners, other hook fasteners, or other means. In embodiments, alligator clips, or other kinds of clips, are attached to the main portion, elongate portion, and/or strap.

The head wrap, in embodiments, includes a main portion 12 made from a cotton fabric, a terry cloth fabric, microfiber material, or other absorbent materials. In embodiments, the strap is made from an elongate piece of elastic material. For example, the strap may be made from elastic, such as the elastic bands that are used in clothing. In other embodiments, the strap is made of plastic, cloth, any of the other materials mentioned for the main portion and/or the elongate portion, the same or different material as the main and/or elongate portion, or multiple materials. In embodiments, the head wrap has a main portion made from silk and is intended to be worn while sleeping. Other materials are contemplated. In an exemplary embodiment, the head wrap is made of silk or silk-like material, has an elastic strap, and attachment tabs. In embodiments, the head wrap is worn for warmth and wool or other insulating materials are used. In embodiments, the head wrap is made from quilted or stuffed materials. In an embodiment, the main portion and/or elongate portion have an inner material and a different outer material. In an example, the inner material is a terry cloth and the outer material is a decorative cloth such as cotton or silk.

In an exemplary embodiment, the height of the main portion is 280 millimeters, the length of the main portion and elongate portion is 680 millimeters, the strap length is 900 millimeters, and the strap width is 32 millimeters.

In embodiments, the main portion of the head wrap includes elastic portions formed on, or attached to the material of the main portion. These can be arranged in a manner to more snugly or securely receive a person's head or a portion of a person's head.

It is contemplated that the head wrap is washable or has portions that are washable, replaceable portions, and/or reusable portions.

The head wrap may be provided in several sizes, to accommodate people of different sizes, as well as people with longer, thicker, thinner, or shorter hair.

In embodiments, the strap has a different color than the main portion, or a decorative design. In embodiments, the main portion is provided in a fabric that has different colors or decorative designs. In embodiments, the material of the main portion and or strap has a coating or other treatment. For example, a mildew resistant coating may be provided on the main portion and or strap. In embodiments, silver iron infused coatings are used. In embodiments, antibacterial and or odor resistant coatings are used. The main portion and/or strap can be made from terrycloth, bamboo fabrics, bamboo terry cloth, Turkish cotton materials, French terry cloth, cotton terry cloth, cotton fabrics, organic cotton, bamboo, microfiber, reconstituted nylon, linen, and blends of one or more of these materials. In embodiments, the main portion and/or strap can be made from silk, mulberry silk, satin, sateen, and/or other materials. In embodiments, the main portion has sections of different materials. In embodiments, the main portion and/or elongate portion or made from fabric cut and sewn to form a shape convenient for receiving at least the top portion of a person's head. In other embodiments, the head wrap can be made from a material that is molded or stretched into shape.

In embodiments, the user puts their head in the main portion 12 so that the front 13 of the head wrap 10 is disposed at the nape of the neck. The user then wraps the elongate portion 22 around the head and applies third attachment 32 to second attachment 31. The user continues by wrapping the strap 24 around the front of the head across the forehead and attaching first attachment 30 to attachment 31. In embodiments, attachment 31 is a double snap. In other embodiments, the attachment 31 has two single snaps. It is contemplated that the head wrap can be applied with the front 13 placed on the forehead and that the shape of the head wrap may be different for this use. In embodiments, the strap of the head wrap has a length to extend at least partially around the user's head.

The head wrap has many benefits. In embodiments, the head wrap has absorbent material that helps absorb water quickly. In embodiments, the head wrap has an antifungal and/or antimicrobial material, or the material of the head wrap has an antifungal and/or antimicrobial coating. The head wrap can minimize frizz and/or breakage. The head wrap can be used for beauty and self-care hair treatments. For example, in the case of overnight hair treatments, the strap keeps the head wrap comfortably secured. The head wrap can be used overnight, for next-day curls. Use of the head wrap overnight can reduce knots and tangles.

In embodiments, the strap can be adjustable in length, to fit all hair types, and hair lengths. For example, the strap can have a buckle allowing the strap to be lengthened or shortened. In embodiments, the main portion and/or elongate portion can be adjustable in size for different head sizes.

In embodiments, the strap is removable or removably attached to the main portion. In embodiments, more than one strap is provided. In embodiments, the strap is long enough to wrap around the head more than once. For example, the strap can wrap around the head one and a half times, two times, etc. In embodiments, the strap may have attachments spaced along the length of the strap. In embodiments, attachments may be spaced along the main portion and/or the elongate portion.

What is claimed is:

1. A head wrap, comprising:

a main portion having a side, a closed top, and an open bottom, the main portion being shaped to receive at least a top portion of a person's head;

an elongate portion extending from the main portion and having an end;

a strap extending from the end of the elongate portion, the strap having a free end; and a first attachment, a second attachment, and a third attachment, the first attachment being disposed at the free end of the strap, the second attachment being disposed at the side of the main portion, and the third attachment being disposed on the end of the elongate portion, the third attachment being arranged for being attached to the second attachment, and the first attachment being arranged for being attached to the second attachment, the strap being long enough to extend from the second attachment, around the main portion and to the second attachment, encircling the main portion.

2. The head wrap according to claim 1, wherein at least one of the first attachment, second attachment, and third attachment comprises a double snap.

3. The head wrap according to claim 1, wherein the main portion is made from an absorbent material.

4. The head wrap according to claim 1, wherein the strap is an elongate piece of elastic material.

5. The head wrap according to claim 1, wherein the main portion is made from a material selected from the group consisting of cotton fabric, terry cloth, silk, reconstituted nylon, and bamboo.

6. The head wrap according to claim 1, wherein the first attachment, second attachment, and third attachment are selected from the group consisting of snaps, double snaps, buckles, hook and loop fasteners, and buttons and buttonhole fasteners.

7. The head wrap according to claim 1, wherein the main portion and elongate portion are made from the same material.

8. The head wrap according to claim 1, wherein the main portion and elongate portion are made from different materials.

9. The head wrap according to claim 1, wherein the main portion has at least one seam.

10. The head wrap according to claim 1, wherein the main portion is made from an insulating material.

* * * * *